US005178378A

United States Patent [19]

Nakajima

[11] Patent Number: 5,178,378

[45] Date of Patent: Jan. 12, 1993

[54] PAPER FEEDER

[75] Inventor: Yoshiaki Nakajima, Nagano, Japan

[73] Assignee: Chinon Kabushiki Kaisha, Suwa, Japan

[21] Appl. No.: 809,251

[22] Filed: Dec. 18, 1991

Related U.S. Application Data

[63] Continuation of Ser. No. 585,634, Sept. 20, 1990, abandoned.

[30] Foreign Application Priority Data

Feb. 9, 1990 [JP] Japan ..... 2-30303

[51] Int. Cl.[5] ..... B65H 00/00

[52] U.S. Cl. ..... 271/116; 271/127; 400/624; 400/629

[58] Field of Search ..... 271/116, 127; 400/624, 400/629

[56] References Cited

U.S. PATENT DOCUMENTS

| | | | |
|---|---|---|---|
| 4,248,415 | 2/1981 | Steinhilber | 271/116 X |
| 4,544,294 | 10/1985 | Runzi | 400/629 X |
| 4,667,244 | 5/1987 | Ishikawa | 271/116 X |
| 4,744,687 | 5/1988 | Nukaya et al. | 400/629 X |
| 4,799,813 | 1/1989 | Steinmetz . | |
| 4,865,305 | 9/1989 | Momiyama et al. | 271/116 |

FOREIGN PATENT DOCUMENTS

| | | | |
|---|---|---|---|
| 11438 | 1/1983 | Japan | 271/116 |
| 61-12366 | 1/1986 | Japan . | |
| 257839 | 11/1986 | Japan | 271/116 |
| 77767 | 7/1988 | Japan . | |

*Primary Examiner*—Robert P. Olszewski
*Assistant Examiner*—Boris Milef

[57] ABSTRACT

A paper feeder including a driven platen which receives paper fed from a paper feed roller mounted on a shaft. Also mounted on the shaft is a freely rotatable gear which cooperates with a one-way clutch by way of interengaging protrusions, to rotate the shaft mounting the paper feed roller. When the paper reaches the platen, the paper is fed at a faster rate than the feed rate of the paper feed roller so that the roller and shaft are rotated by the action of the paper. Whereupon, the protrusions disengage and the gear does not cause rotation of the one-way clutch until after the first sheet of paper has been completely fed.

5 Claims, 2 Drawing Sheets

PAPER FEEDER

This application is a continuation of application Ser. No. 07/585,634 filed on Sept. 20, 1990, now abandoned.

BACKGROUND OF THE INVENTION

1. Field of the Invention

The present invention relates to an automatic paper feeder used with a printer or the like.

2. Description of Related Art

As is disclosed in, e.g., Japanese Patent Laid-Open Publication No. 12366/1986, a known paper feeder used with a printer is arranged such that a platen for feeding the paper during printing and an ejection of paper and a paper feed mechanism for automatically feeding the paper to the platen are combined to serve as a driving source. In this type of paper feeder having no dedicated driving source, as is stated in the foregoing Publication, there has hitherto been adopted a structure in which power is transferred from the driving source to the paper feed mechanism by the use of intricate cam and link mechanisms interlocking with forward and reverse rotations of the driving source for rotationally driving the platen. After ejecting the paper, the platen is rotated in a reverse direction, i.e., in a direction opposite to that during the printing operation, thus driving the cam and link mechanisms. The power is transferred from the driving source to the paper feed mechanism. Thereafter, the paper is fed by rotating the platen forwards, and at the same time the power transfer from the driving source to the paper feed mechanism is discontinued.

The platen continues its forward rotation until the printed paper is completely ejected. The platen does not start rotating in the reverse direction until the ejection of the paper has been finished. Since one to two seconds after starting the reverse rotation are utilized for a back feed (the paper is fed back), this short period of time is not employed for change-over of the power transfer to the paper feed mechanism. The cam is initially locked after the platen has reversely rotated a given amount in 1 to 2 seconds, and the link is thereby caused to function, thus effecting change-over to the paper feed mechanism. After the change-over is finished, the platen rotates forwardly, and paper feeding is initiated.

In the prior art paper auto-feeder, the power is transferred to the paper feed mechanism by utilizing the reverse rotations of the platen, and hence the platen is not allowed to rotate in a reverse direction until the printed paper is completely ejected. Thus, there arises a problem in the amount of time required for positioning the next paper sheet to the platen, i.e., feeding the paper, because an ejection time is added to the time wherein the platen rotates in the reverse direction. More specifically, the paper feed interval between the first and second sheets of paper is lengthened, resulting in a waste of time. The use of the complicated cam and link mechanisms also leads to a requirement for a large number of parts. This in turn creates problems by enlarging the size of the device, lessening the manufacturability of the device and increasing the costs of the device.

SUMMARY OF THE INVENTION

Accordingly, it is a primary object of the present invention to obviate the above-mentioned problems which have been encountered in the prior art devices.

In this regard, it is an object of the present invention to provide a paper feeder which is capable of reducing the time interval necessary between the feeding of successive sheets.

It is also an object of the present invention to decrease the number of parts used in a paper feeder.

Among the further objects of the present invention are to make the paper feed itself compact, to make it easier to manufacture and to decrease the costs relative thereto.

The present invention achieves the above objects by providing a paper feeder which includes a driven platen which feeds paper sheets, a rotatable paper feed roller mounted on a shaft for feeding the paper sheets to the platen, a first power transfer body, such as a gear, rotatably supported on the paper feed roller shaft and rotating in a rotating direction of the paper feed roller shaft when feeding the paper and interlocking with the platen. A second power transfer body, such as a one-way clutch, is supported on the paper feed roller shaft so as to be rotatable only in a direction opposite to the rotating direction of the first power transfer body. Protrusions are fixedly provided on the first and second power transfer bodies and are engagably located about the rotary axis of the paper feed roller shaft. The paper feed rate of the paper feed roller is set smaller than the paper feed rate of the platen.

In the paper feeder of the present invention, the first power transfer body rotatably supported on the paper feed roller shaft is rotated in an interconnecting or interlocking manner with the platen driven by the driving source. During the feeding of paper, but before the platen is supplied with paper, the protrusion formed on the first power transfer body impinges on the protrusion shaped on the second power transfer body in the rotating direction. The second power transfer body rotates together with the first power transfer body but is arranged to be rotatable with respect to the paper feed roller shaft only in a direction opposite to the rotating direction of the first power transfer body, whereby the paper feed roller shaft and the paper feed roller rotate together with the two power transfer bodies. The paper is fed to the platen by the rotating paper feed roller. When a paper sheet reaches the platen and is then fed by the platen, the paper feed roller is rotated by this paper at a higher velocity than during the feed of paper by the rotating paper feed roller, because the paper feed rate provided by the paper feed roller is smaller than the paper feed rate provided by the platen. Hence, the first power transfer body simply idles with respect to the paper feed roller shaft which is rotating integrally with the paper feed roller, whereas the second power transfer body rotates together with the paper feed roller shaft for a short while. As a result, the protrusion of the second power transfer body temporarily separates from the protrusion of the first power transfer body and abuts against the same protrusion, but from the opposite direction to that encountered during the feed of the paper. Subsequently, the second power transfer body rotates idly with respect to the paper feed roller shaft and relatively in the opposite direction to the rotating direction of the paper feed roller shaft but rotates together with first power transfer body. Then, printing is effected on the paper fed by the platen, and the paper which has undergone complete printing is ejected by the platen to the paper ejection stacker. While on the other hand, the paper disengages from the paper feed roller during the printing operation. When the paper disengages from the paper feed roller, power is no longer transferred from the paper fed by the platen to the paper feed roller, as a consequence of which the rotating velocities of the paper feed roller, the paper feed roller shaft and the second power transfer body are temporarily lowered. The protrusion of the first power transfer body which goes on rotating impinges again on the protrusion of the second power transfer body in the rotating direction. Thereafter, the second power transfer body, the paper feed roller shaft and the paper feed roller rotate together with the first power transfer body. The next sheet of paper is fed out by the paper feed roller. It is to be noted a paper feed interval between subsequent sheets of paper is prescribed by the widths of the protrusions of the two power transfer bodies and the diameter of the paper feed roller.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 4:
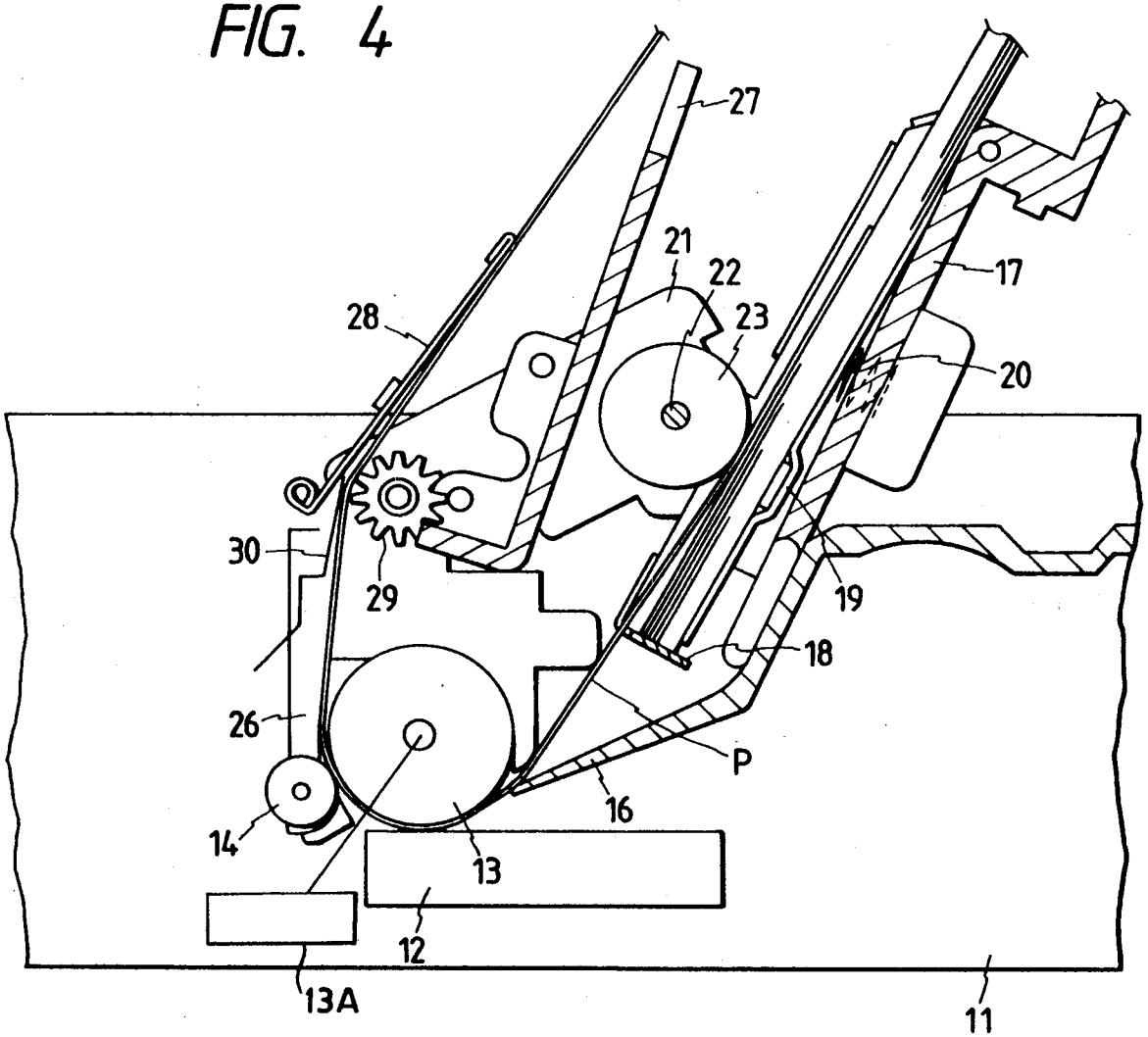
FIG. 4 is a side view partially depicting a printer incorporating the paper feeder.

Referring in detail to the drawings, there is illustrated in FIG. 4, a paper feeder constructed in accordance with the invention which is being utilized with a printer.

The printer body 11 supports a printing head 12 for printing on a sheet of paper P by cooperating with a platen 13 in the shape of a roller and a pressing roller 14. A paper guide 16 guides the paper sheets from a paper feed stacker 17 where the sheets abut against a paper holder plate 18 to the platen 13. A pressing plate 19 which is spring biased by a coil spring 20 presses the top sheet of paper in the paper feed stacker 17 against a paper feed roller 23 positioned on shaft which is supported by frame 21.

The paper feed stacker 17 serves to provide a pile of sheets of paper P on the paper holder plate for use in printing. The paper feed roller 23 feeds the paper P sheet by sheet via the paper guide 16 by frictional contact while it is being rotated together with platen 13. Each sheet of paper is guided from pressing roller 14 by a paper guide 26 to a paper ejection stacker 27. In this regard, the platen 13 is rotationally driven by an unillustrated electric motor, or power source 13A shown schematically in FIG. 4, so that the platen 13 cooperates with the printing head 12 and the pressing roller 14 to seize a sheet of paper P during printing and paper-ejecting operations by frictional contact and send the paper P via the paper guide 26 to the paper ejection stacker 27.

Thus, sheets of paper P which have been printed upon are stacked on the paper ejection stacker 27. In particular, the paper P is fed between the toothed-roller 29 and the leaf spring 30 to be positioned under the paper holder 28.

Figure 2:
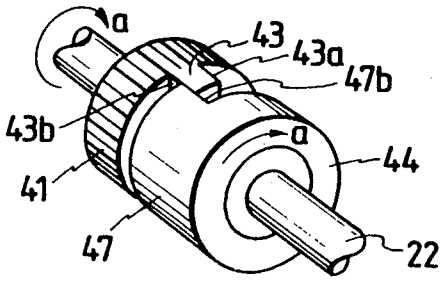
FIG. 2 is a perspective view illustrating a state where paper feeding has been finished.
Figure 3:
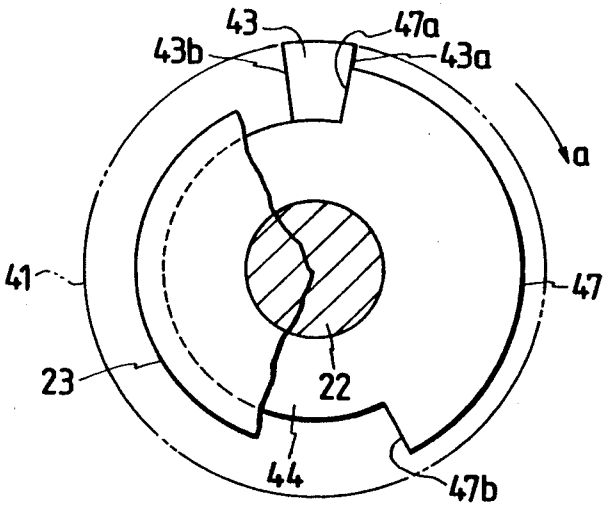
FIG. 3 is a side view of assistance in explaining the paper feeding state.
Figure 1:
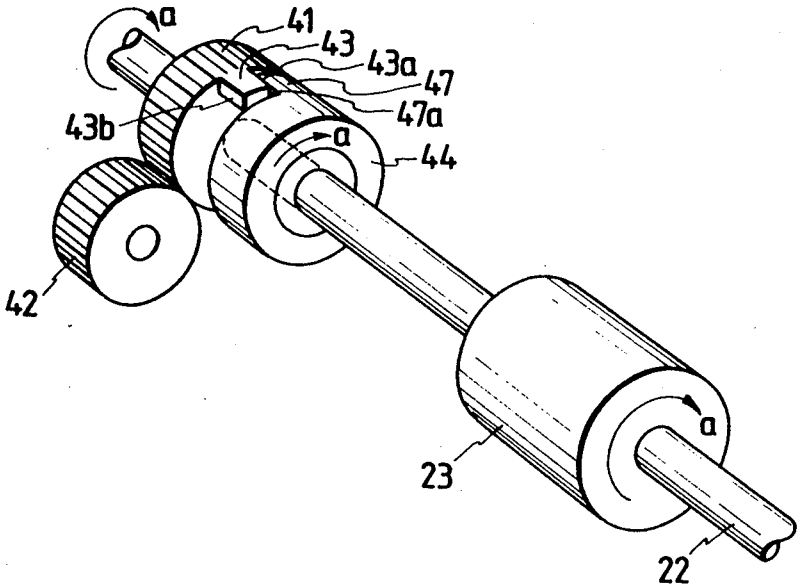
FIG. 1 is a perspective view illustrating a state where the paper is fed.

FIGS. 1-3 illustrate the arrangement utilized to rotate the paper feed roller shaft 22 of the paper feeder.

The paper feed roller shaft 22 is rotatably supported on the frame 21, and has a rotary axis which is parallel to the rotary axis of the platen 13. One or a plurality of paper feed rollers 23 are coaxially supported on the paper feed roller shaft 22. The paper feed rollers 23 are fixed to the paper feed roller shaft 22 or arranged to be nonrotatable relative thereto at least in the direction of arrow a i.e, in the illustrated clockwise direction. The rollers 23 rotate together with the paper feed roller shaft 22.

Supported coaxially on one end of the paper feed roller shaft 22 is a driven gear 41 which serves as a first power transfer body and is rotatably mounted so that the gear 41 is rotatable both in a forward direction and in a reverse direction. The gear 41 is rotationally driven by a driving source in the arrowed direction a via a gear train 42 meshing with unillustrated gears. The driven gear 41, that is, has an interlocking arrangement with the platen 13, and an end surface of the gear 41 is integrally formed with a protrusion 43.

Also supported coaxially on one end of the paper feed roller shaft 22 is a one-way clutch 44 which serves as a second power transfer body arranged such that a housing is supported to have a unidirectional rotation on an outer periphery of a base body fixed to the paper feed roller shaft 22. The one-way clutch 44 is attached to the paper feed roller shaft 22 so that the housing is rotatable about the rotary axis of the paper feed roller shaft 22 only in a direction opposite to the rotating direction of the driven gear 41 but is nonrotatably locked in the arrowed direction a. A protrusion 47 is shaped integrally on an outer peripheral or end surface of the housing of the one-way clutch 44. The protrusion 47 and the protrusion 43 formed on the driven gear 41 are disposed on adjacent peripheries about the rotary axis of the paper feed roller shaft 22 so that side surfaces **43*a*, 43*b*, 47*a*, and 47*b* impinge on each other. Note that a central angle of a fan shape circumscribed by the side surfaces 47*a* and 47*b* of the protrusion 47 of the one-way clutch 44 measures 142°, as shown in FIG. 3**.

The paper P is fed by the paper feed roller 23 at a slower rate than the feed rate provided by the platen 13. This is accomplished by the reduction ratio of the gear train 42 or by the diameter of the paper feed roller 23 which is utilized.

DESCRIPTION OF THE OPERATION

The paper feeder operates in the following manner when utilized with a printer.

The platen 13 is rotationally driven by power source 13 A shown schematically in FIG. 4. In addition, the driven gear 41 is driven to rotate in the direction of arrow a in a manner whereby it is interlocked with the platen 13.

As illustrated in FIGS. 1 and 3, where the platen 13 has not yet been supplied with paper during the paper feeding process, the protrusion 43 shaped on the driven gear 41 abuts against the protrusion 47 of the housing of the one-way clutch 44 in the rotating direction. To be more specific, the side surface **43*a* of the protrusion 43 of the driven gear 41 impinges on the side surface 47*a* of the protrusion 47 of the one-way clutch 44, whereby the housing of the one-way clutch 44 rotates together with the driven gear 41. At this time, the housing of the one-way clutch 44 is rotatable relative to the paper feed roller shaft 22 only in the opposite rotating direction a of the driven gear 41, viz., it is nonrotatable relative to the paper feed roller shaft 22** in the rotating direction a.

With this arrangement, the paper feed roller shaft 22 rotates together with the driven gear 41 and the housing of the one-way clutch 44, and simultaneously the paper feed roller 23 likewise rotates together with the roller shaft 22. The rotating paper feed roller 23 feeds a sheet of paper P located in the paper feed stacker 17 to the platen 13.

When the sheet of paper P reaches the platen 13 and is in turn fed by the platen 13, printing is performed on the sheet of paper P by means of the printing head 12. After the sheet of paper P has been thus caught between the printing head 12 and the platen 13, since the feed rate of the paper P by the paper feed roller 23 is smaller or slower than the paper rate of the platen 13, the paper feed roller 23 is forcibly rotated by the paper P at this time. Consequently, the paper feed roller 23 rotates in the direction a faster than during the feed of paper by the paper feed roller 23. Hence, the paper feed roller 23 together with the paper feed roller shaft 22, rotates at a higher velocity than the driven gear 41, and it follows that the driven gear 41 idly rotates relatively in the opposite direction to the direction a with respect to the paper feed roller shaft 22. While on the other hand, the housing of the one-way clutch 44 rotates together with the paper feed roller shaft 22 by dint of friction between the housing itself and the base body, with the result that the side surface 43*a* of the protrusion 43 of the driven gear 41 gradually moves away from the side surface 47*a* of the protrusion 47 of the one-way clutch 44.

This state continues for a short while, and thereafter, as illustrated in FIG. 2, the protrusion 47 of the one-way clutch 44 impinges on the protrusion 43 of the driven gear 41 from a direction opposite to that during the feed of paper. More specifically, the side surface 43*b* of the protrusion 43 of the driven gear 41 abuts against the side surface 47*b* of the protrusion 47 of the one-way clutch 44. After this impingement, the housing of the one-way clutch 44 can not rotate any more with respect to the driven gear 41 and rotates idly relatively in the direction reverse to the rotating direction a of the paper feed roller shaft 22 with respect to the paper feed roller shaft 22. The housing rotates together with the driven gear 41 while the side surfaces 43*b* and 47*b* remain in engagement with each other. This state continues for a short while.

The sheet of paper P on which printing has completely been effected is ejected by the platen 13 directly to the paper ejection stacker 27.

As noted previously, each sheet of paper P is initially fed by passing under the paper feed roller 23 during the printing process. When the sheet of paper P is no longer in engagement with the paper feed roller 23, the paper feed roller 23 is no longer rotated by the sheet of paper P being fed by the platen 13. Whereupon, the paper feed roller 23, the paper feed roller shaft 22 and the housing of the one-way clutch 44 temporarily stand stationary. In contrast, the driven gear 41 goes on rotating. After the driven gear 41, for instance, has made approximately one circuit, the side surface 43*a* of the protrusion 43 of the driven gear 41 again impinges on the side surface 47*a* of the protrusion 47 of the one-way clutch 44, whereby the paper feed roller shaft 22, as explained earlier, rotates together with the driven gear 41. The paper feed roller 23 resumes feeding the paper, and the subsequent sheet of paper P is thereby fed out.

Sheets of paper P are automatically consecutively supplied by repeating the above-mentioned operations.

After the first paper P passes through the paper feed roller 23, the driven gear 41 alone rotates until the side surface 43*a* of the protrusion 43 of the driven gear 41 impinges on the side surface 47*a* of the protrusion 47 of the one-way clutch 44. Since the paper feed roller 23 is not driven when there is no engagement of the protrusions, paper feeding is not performed at this time. An interval of time between the feeding of sheets of paper P is obtained depending on the widths of the protrusions 43 and 47 of the one-way clutch 44 and of the driven gear 41 and also the selected diameter of the paper feed roller 23. Therefore, the successive sheets of paper P are positively fed out at a constant interval.

As can be seen from the foregoing construction and operation, it is possible to eliminate a considerable number of components in the present invention. The prior art paper auto-feeder requires a good number of components because of the use of complicated cam and link mechanisms. The paper feed roller shaft 22, the paper feed roller 23 and the gear 41 are, as in the case of the prior art devices, necessary for the paper auto-feeder of the present invention. However, no special component is added thereto in contrast to the conventional devices. Hence, the manufacturability is enhanced, while the costs can be reduced.

The paper auto-feeder is simply constructed and can therefore be made compact. The device can readily be incorporated into a printer which is required to be miniaturized.

In the prior art paper auto-feeders, the change-over is effected by utilizing the forward and reverse rotations of the platen. The reverse rotation can not be made until after the paper has completely been ejected, and hence it takes a relatively long time to feed the next paper. According to the paper auto-feeder of the invention, a sheet of paper can be fed simultaneously while another sheet of paper is ejected. It is therefore possible to save a considerable amount of time during the subsequent feeding of sheets of paper.

In addition, the time interval between the first and second sheets of paper P can be easily varied by changing the widths of the protrusions 43 and 47 of the driven gear 41 and of the one-way clutch 44 and also the diameter of the paper feed roller 23.

It is noted that the illustrated embodiment of the present invention shows the paper feeder incorporated into a printer, however, the paper feeder of the invention can be used with other machines such as a facsimile transmitter/receiver or a copying machine.

The invention being thus described, it will be obvious that the same many be varied in many ways. Such variations are not to be regarded as a departure from the spirit and scope of the invention, and all such modifications as would be obvious to one skilled in the art are intended to be included within the scope of the following claims.

What is claimed:

1. A paper feeder comprising:

a platen, driven in one direction only by a power source for feeding paper;

a rotatable paper feed roller shaft having a rotary axis;

a paper feed roller, mounted on said paper feed roller shaft, for feeding the paper to said platen while rotating together with said paper feed roller shaft;

a first power transfer means rotatably supported on said paper feed roller shaft and rotating in a rotating direction of said paper feed roller shaft when feeding the paper, means for interlocking the rotation of said first power means with the rotation of said platen in said one direction;

a second power transfer means supported on said paper feed roller shaft and being mounted to be rotatable relative to said paper feed roller shaft only in a direction opposite to the rotating direction of said first power transfer means;

protrusions fixedly provided on said first and second power transfer means and positioned about said rotary axis of said paper feed roller shaft so as to engage each other; and the rate of paper feed of said paper feed roller being smaller than the rate of paper of said platen.

2. A paper feeder as recited in claim 1 wherein said first power transfer means is a gear.

3. A paper feeder as recited in claim 1 wherein said second power transfer means is a one-way clutch.

4. A paper feeder as recited in claim 1 wherein said paper feed roller feeds paper from a paper feed stacker which includes a spring biased pressing plate.

5. A paper feeder as recited in claim 1 wherein said platen feeds paper to a paper guiding means and then to a paper ejection stacker.

* * * * *